428-919 SR
3/1/83 XR 4,375,488

United States Patent [19]

Hogan

[11] 4,375,488

[45] Mar. 1, 1983

[54] CAMOUFLAGE MATERIAL

[75] Inventor: Mark J. Hogan, Lake Helen, Fla.

[73] Assignee: Brunswick Corporation, Skokie, Ill.

[21] Appl. No.: 368,744

[22] Filed: Apr. 15, 1982

[51] Int. Cl.[3] ..... F41H 3/00

[52] U.S. Cl. ..... 428/17; 428/133; 428/919

[58] Field of Search ..... 428/150, 919, 17, 133, 428/134

[56] References Cited

U.S. PATENT DOCUMENTS

| | | | |
|---|---|---|---|
| 875,595 | 12/1907 | Overbury | 428/134 X |
| 881,024 | 3/1908 | Overbury | 428/134 X |
| 2,351,142 | 6/1944 | Mitchell | 428/919 X |
| 2,362,786 | 11/1944 | Williams | 428/919 X |
| 2,370,734 | 3/1945 | Jost | 428/919 X |
| 2,911,652 | 11/1959 | Ekman | 428/919 X |
| 3,069,796 | 12/1962 | Ruter | 428/919 X |
| 3,650,881 | 3/1972 | Giannone, Sr. | 428/133 |
| 3,733,606 | 5/1973 | Johansson | 428/919 X |
| 3,779,448 | 12/1973 | Wootten | 428/133 X |
| 4,323,605 | 4/1982 | Rush | 428/919 X |

FOREIGN PATENT DOCUMENTS

| | | | |
|---|---|---|---|
| 756383 | 9/1956 | United Kingdom | 156/253 |

*Primary Examiner*—Henry F. Epstein

*Attorney, Agent, or Firm*—William G. Lawler, Jr.

[57] ABSTRACT

Camouflage material is provided for concealing personnel and equipment from people or animals having geometric and/or color perception. A sheet of material has two dimensions, such as length and width, with a plurality of spaced apart rows of cuts extending across the sheet in both directions. The rows of cuts preferably are spaced apart generally equidistant and generally parallel to each other in both directions to form a generally uniform pattern of cuts. In the preferred embodiment, the cuts are generally W-shaped with two leg portions or generally truncated W-shaped with one leg portion, the leg portions extending at an angle to the direction of the respective row of which the cut is a part. The pattern is such that the cuts in each row in one direction either extend between the cuts of the rows in the opposite direction or completely interrupt the cuts of the rows in the opposite direction so that the cuts in both direction interlock. Thus, stretching the material in either direction extends the inverted base portions of the cuts in the rows transverse to the stretch direction out of the plane of the sheet. This effects extension of cuts out of the plane of the sheet across substantially the entire sheet when the sheet is stretched either in a length-wise or width-wise direction.

25 Claims, 4 Drawing Figures

FIG. 1
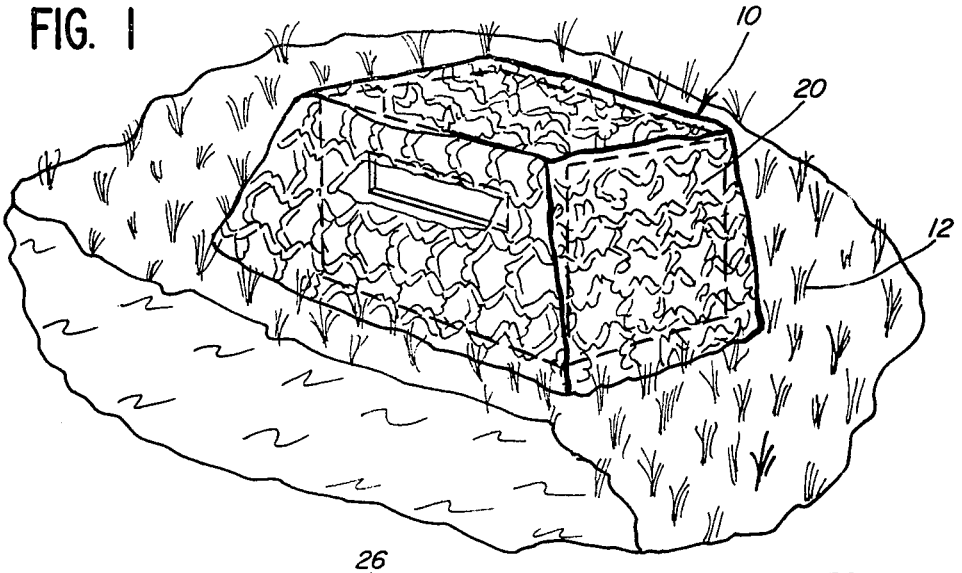
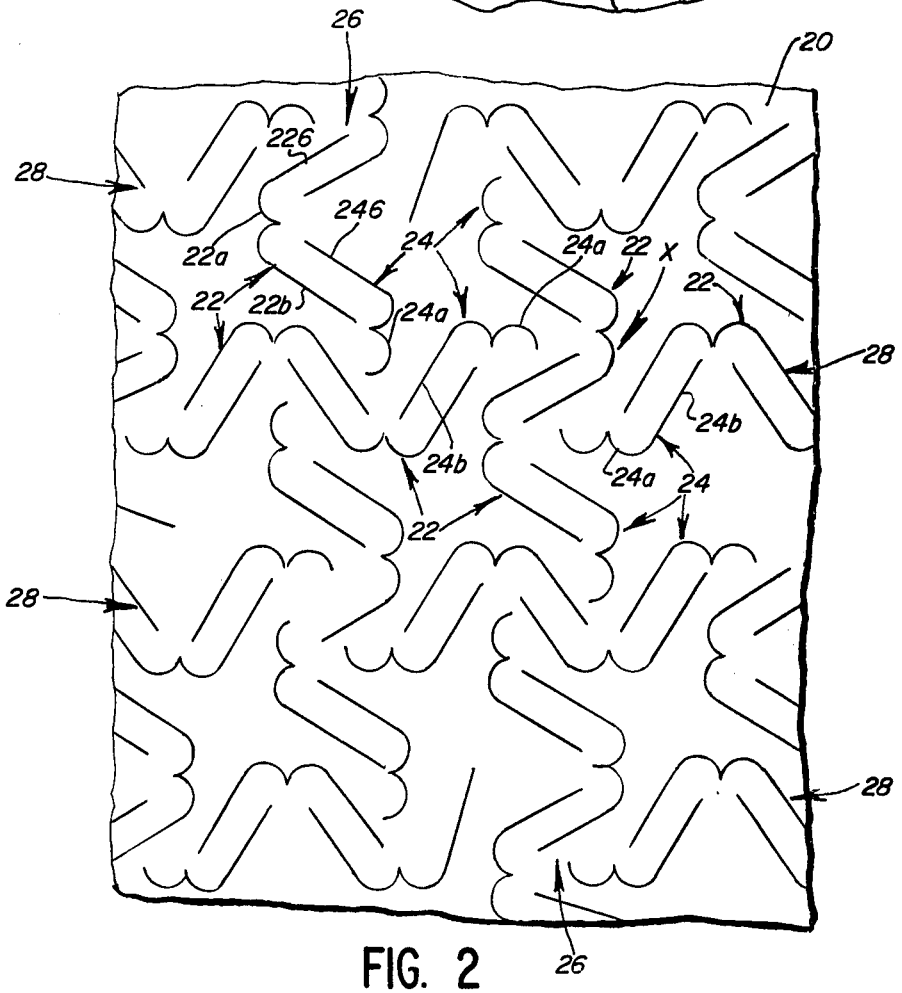
FIG. 2

CAMOUFLAGE MATERIAL

BACKGROUND OF THE INVENTION

This invention relates to camouflage material and, more particularly, to an improved incising arrangement for the material to produce an improved three-dimensional effect.

Camouflage screens are used in civilian and military applications to conceal personnel and equipment from people or animals having geometric and/or color perception. The screen assists in blending objects into the surroundings by providing colors which complement the surroundings and preferably a random profile. The most well known camouflage screens or nets simply consist of a flat multi-colored sheet. However, such camouflage is easily recognized due to its flat two-dimensional surface. Cord netting or fish nets garnished with colored strips, etc. have been used to conceal the flat two-dimensional surface. However, such netting is expensive to manufacture and difficult to maintain.

Camouflage material for civilian and military use has generally been found to be effective where the material has openings and will assume a posture with respect to the equipment or persons being disguised that best simulates the surrounding grass, leaves, other foliage, or the like. According to certain known camouflage methods many slits are cut into a sheet with the slits being disposed alternating in parallel rows. Pulling or stretching the sheet in a direction transverse to the rows of slits produces a mesh-like arrangement of the material with the material surrounded by the slits extending out of the plane of the sheet to produce a somewhat three-dimensional effect. Examples of such camouflage material are shown in U.S. Pat. No. 3,069,796 to R. G. Ruter, and in U.S. application Ser. No. 113,468 to C. R. Rush filed in Jan. 21, 1980 now U.S. Pat. No. 4,323,605, dated Apr. 6, 1982 and assigned to the assignee of the present invention. Both Ruter and Rush show incising methods wherein the slits or cuts are arranged in rows whereby pulling or stretching the sheet generally perpendicularly to the rows effects projection of the slits out of the plane of the sheet. However, with the slits arranged in defined rows, pulling or stretching the sheet generally parallel to the rows barely results in the three-dimensional effect. Ruter shows an alternate method wherein the slits are of different sizes and randomly displaced across the sheet, but this alternate method still does not permit extenuation of the sheet out of the plane thereof in a uniform manner or equal in all directions. There is a need to solve this problem by providing a camouflage sheet of material which is incised in such a manner as to effect three-dimensional extenuation of the sheet equally in all directions regardless of the direction of pulling or stretching on the sheet.

Another problem with prior incising methods results from the shape of the slits or cuts themselves. In Ruter, the cuts are generally U-shaped and the extenuated U-shaped material portions tend to roll as the material is stretched. The Rush incising method is a considerable improvement over Ruter in that the slits are generally V-shaped. The result of forming V-shaped incising is that a dihedral is formed which causes the incised material to extend away from the plane of the camouflage sheet and become relatively stiff when the sheet is stretched. However, the V-shaped incising method reduces the amount of extenuating material versus the U-shaped incising method. It would be desirable that the individual cuts or slits be of sufficient size to effect substantial extenuation of the sheet but which also does not roll when the sheet is stretched.

The present invention is directed to solving the aforesaid problems of the prior art by providing a new and improved sheet of camouflage material which provides for generally uniform and equal extenuation of the sheet when stretched regardless of the direction of pulling or stretching the sheet, as well as a new and improved incising configuration which provides substantial extenuation without rolling of the material.

SUMMARY OF THE INVENTION

This invention relates to camouflage material and, more particularly, to an improved incising method for the material to produce an improved three-dimensional effect.

In the exemplary embodiment of the invention, camouflage material is provided and comprises a sheet of material having two dimensions, such as length and width. In general, the sheet of material has an incising pattern of interlocked, criss-crossed rows of cuts formed over the length and width of the sheet. The cuts are shaped and arranged in relation to the rows thereof whereby stretching the material in either a length-wise or width-wise direction effects extenuation of the cuts out of the plane of the sheet across substantially the entire sheet containing the cuts.

In particular, the criss-crossed rows of cuts are spaced apart generally equidistant and generally parallel to each other in both directions of the sheet. Each cut has at least one leg portion and an inverted base portion with the leg portion extending at an angle to the direction of the respective row of which the cut is a part. In the preferred embodiment, the cuts in each row comprise interlocked and alternately inverted generally W-shaped cuts with two leg portions or truncated generally W-shaped cuts with one leg portion. Each row of cuts in each direction is completely interrupted at spaced intervals by the cuts of the rows in the opposite direction to provide the interlock of rows. In this manner, the uniform pattern of interlocked, criss-crossed rows of cuts effect uniform extenuation of the material out of the plane of the sheet regardless of the direction which the sheet is pulled or stretched.

The W-shaped or truncated W-shaped cuts effect substantial areas of extenuation, yet the pointed base portions of the cuts prevent the extenuated material from rolling.

An object, therefore, of the present invention is to provided a new and improved incised camouflange material of the character described.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a perspective view of the improved camouflage material of the present invention employed in a natural environment;

FIG. 2 is a plan view of a portion of a sheet of camouflage material having the improved incising pattern of the present invention cut therein;

DETAILED DESCRIPTION OF THE INVENTION

Figure 3:
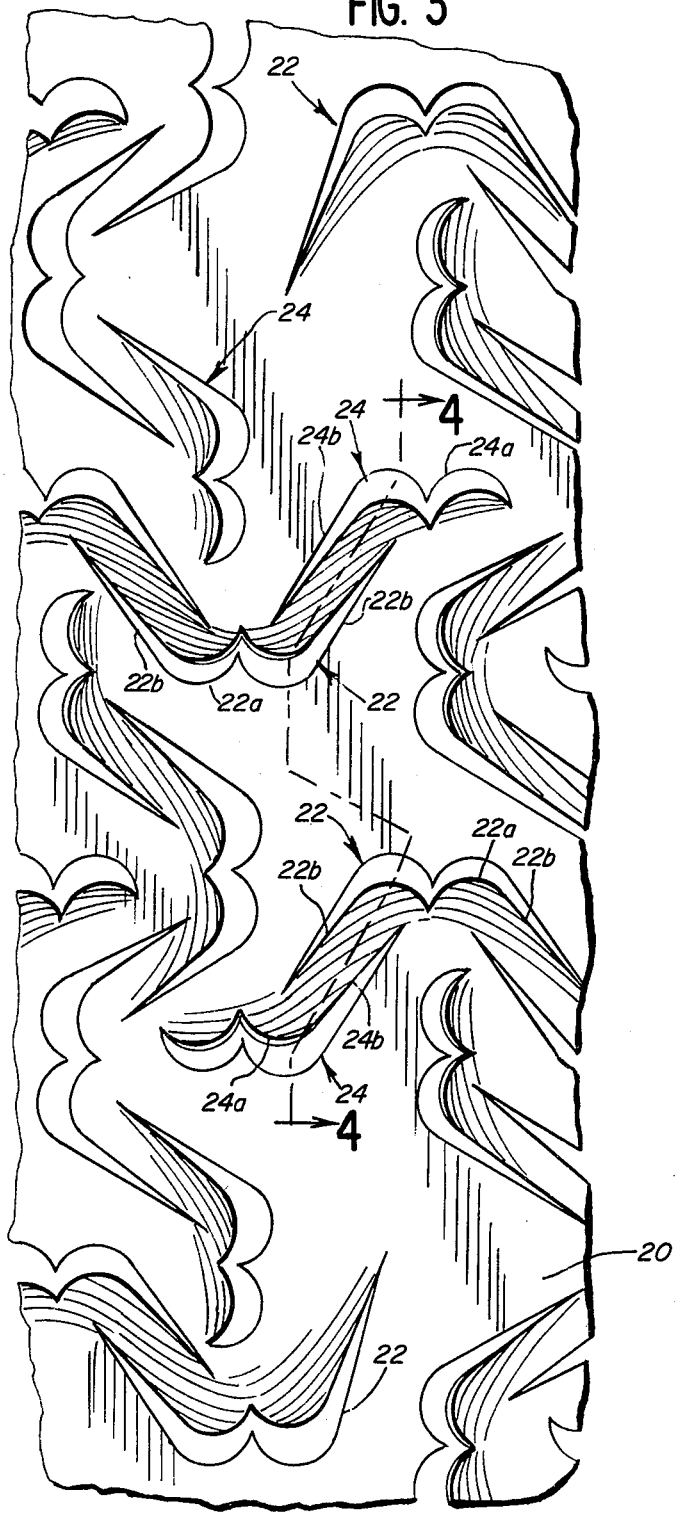
FIG. 3 is a plan view of a portion of the sheet of material of FIG. 2 with the incised portions of the sheet extenuated in response to stretching of the sheet.

Referring to the drawings in greater detail and first to FIG. 1, a low structure 10 is illustrated in a natural herbivorous setting with vegetation, such as grass 12, bushes, or other foliage (not shown) most likely bearing leaves. Structure 10 is covered with a stretched sheet 20 of camouflage material having incising cuts 22, 24 formed therein. It is to be understood that structure 10 could be a recreational structure, such as a duck blind, or a military structure or could contain equipment or personnel. The purpose of the camouflage is to not only prevent detection from the air, but also to prevent detection from the ground. The camouflage provides a screen system used to conceal the personnel and/or equipment from people or animals having geometric and/or color perception. To that end, the sheet normally would be multi-colored prior to incising in accordance with the present invention. A plain flat, two-dimensional sheet is easily recognized because of the defined lines normally created by draping the sheet over a form or the like. Incising the sheet causes three-dimensional extenuation thereof in response to stretching the sheet in a pre-determined direction. The incised camouflage sheet of the present invention is omni-directional.

More particularly, FIG. 2 illustrates camouflage sheet 20 having an incising pattern cut therein in accordance with the present invention. The pattern comprises a plurality of spaced apart rows, generally designated 26 and 28, of cuts 22, 24 extending across the sheet in the direction of both dimensions thereof, such as the length and width of the sheet. For clarity purposes herein, rows 26 will be referred to as "vertical" rows and rows 28 will be referred to as "horizontal" rows in relation to that arrangement shown in FIG. 2.

For reasons described in greater detail hereinafter, cuts 22 are generally W-shaped and cuts 24 are generally truncated W-shaped. Each cut has an inverted, pointed base portion **22*a* and 24*a*, respectively. Both cuts have leg portions, two leg portions 22*b* for the generally W-shaped cuts 22 and one leg portion 24*b* for truncated W-shaped cut 24**.

In general, the rows 26, 28 of cuts are arranged in an incising pattern of interlocked, criss-crossed rows of cuts formed over the length and width of the sheet. Such an interlocked, criss-crossed pattern results in uniform extenuation of portions of the sheet out of the plane of the sheet across substantially the entire sheet containing the cuts, regardless of the direction of pulling or stretching the sheet.

In particular, the rows 26 of cuts are spaced apart generally equidistant and generally parallel to each other vertically of the sheet. Rows 28 of cuts are spaced apart generally equidistant and generally parallel to each other horizontally of the sheet. The rows are interlocked by portions of the cuts in each row intersecting or completely interrupting the cuts of the rows in the opposite direction. In addition, the W-shaped cuts or truncated W-shaped cuts in each row are alternately inverted such that the legs of the cuts protrude into the adjacent cuts alongside the legs of the adjacent cuts.

The interlocking of the rows of cuts can best be understood by viewing the area "X" in FIG. 2. It can be seen that horizontal row 28 of cuts 22, 24 in the area X has been completely interrupted by the vertical row 26 of cuts 22, 24 in that area. Furthermore, pointed base portions **24*a* of cuts 24 in row 28 protrude or extend between the legs of adjacent cuts in vertical row 26. Consequently, not only is there a complete interruption of horizontal row 28 by vertical row 26, but the cuts of horizontal row 28 extend into a projection of the vertical row, namely between the legs of the cuts in the vertical row. This single area X is repeated throughout the incising pattern of the present invention illustrated in FIG. 2. Each horizontal row is interrupted and interlocked with each vertical row at spaced intervals thereof, and each vertical row is interrupted and interlocked with each horizontal row at spaced intervals thereof. It is readily apparent that with the uniform incising pattern of interlocked, criss-crossed rows of cuts described above is effective to cause extenuation of the sheet 20** of camouflage material out of the plane of the sheet regardless of the direction which the sheet is pulled or stretched. This is a vast improvement over the prior art wherein distinct rows of cuts in only one direction are provided, or wherein randomly oriented and different sizes of cuts are provided.

Figure 4:
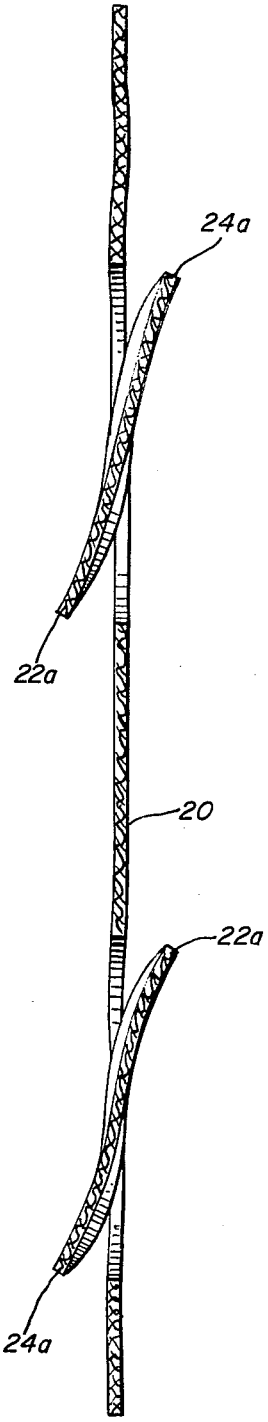
FIG. 4 is a sectional view taken generally along line 4—4 of FIG. 3.

FIGS. 3 and 4 illustrate the three-dimensional extenuation of camouflage sheet 20 in response to stretching thereof. It should be pointed out that stretching is shown in both directions to further facilitate the illustration. These figures also illustrate the important feature of the invention of forming the cuts in a generally W-shaped or truncated W-shaped configuration. It can be seen that such a W-shaped configuration provides for a substantial area, with each cut, to be extended beyond the plane of the camouflage sheet. Yet, the pointed inverted base portions **22*a*, 22*b*** of the cuts prevent the extenuated material from rolling. This is true because the pointed shapes form a dihedral which causes the incised material to become relatively stiff when the material is stretched and, thus, avoiding rolling of the incised material.

It will be understood that the invention may be embodied in other specific forms without departing from the spirit or central characteristics thereof. The present examples and embodiments, therefor, are to be considered in all respects as illustrative and not restrictive, and the invention is not to be limited to the details given herein.

What is claimed is:

1. A camouflage material comprising a sheet of material having two dimensions, a plurality of spaced apart rows of cuts extending across the sheet in the direction of each of said dimensions, each cut having at least oneleg portion and an inverted base portion with the leg portion extending at an angle to the direction of the respective row of which the cut is a part, at least some of the cuts in each row in either direction extending between other cuts in that same row, and at least some of the cuts in each row in one said direction extending between the cuts of the rows in the opposite direction, so that the rows of cuts in both directions interlock whereby stretching said material in either direction extends the inverted base portions of the cuts in the rows transverse to the stretched direction in a uniform manner out of the plane of the sheet.

2. The camouflage material of claim 1 wherein said rows of cuts are spaced apart generally equidistant and generally parallel to each other in each said direction.

3. The camouflage material of claim 1 wherein at least some of said rows of cuts in at least one said direction are completely interrupted by the cuts of at least some of said rows in the opposite direction to provide said interlock.

4. The camouflage material of claim 3 wherein said rows of cuts are spaced apart generally equidistant and generally parallel to each other in each said direction.

5. The camouflage material of claim 4 wherein each of said rows of cuts in each said direction is completely interrupted by the cuts of at least some of said rows in the opposite direction to provide said interlock.

6. The camouflage material of claim 1 wherein each of said rows of cuts in each said direction is interrupted by the cuts of alternate rows in the opposite direction to provide said interlock.

7. The camouflage material of claim 1 wherein at least some of said cuts are generally W-shaped with two said leg portions.

8. The camouflage material of claim 7 wherein the legs of at least some of the W-shaped cuts in the rows in one said direction extend into the rows in the opposite direction to provide said interlock.

9. The camouflage material of claim 7 wherein at least some of said cuts are generally truncated W-shaped cuts with one said leg portion.

10. The camouflage material of claim 9 wherein the truncated portions of at least some of said truncated W-shaped cuts in the rows in one said direction extend into the rows in the opposite direction to provide said interlock.

11. A camouflage material comprising a sheet of material having a pattern of interlocked, criss-crossed rows of cuts formed over the length and width of the sheet, at least some of the cuts in any one row being interlocked, and at least some of the cuts in each row in a lengthwise direction being interlocked with the cuts in a widthwise direction, said cuts being shaped in relation to said rows thereof whereby stretching said material in either a lengthwise or widthwise direction effects extension of the cuts out of the plane of the sheet in a uniform manner across substantially the entire sheet containing the cuts.

12. The camouflage material of claim 11 wherein said rows of cuts are spaced apart generally equidistant and generally parallel to each other in each said direction.

13. The camouflage material of claim 11 wherein at least some of said rows of cuts in at least one said direction are completely interrupted by the cuts of at least some of said rows in the opposite direction to provide said interlock.

14. The camouflage material of claim 13 wherein said rows of cuts are spaced apart generally equidistant and generally parallel to each other in each said direction.

15. The camouflage material of claim 14 wherein each of said rows of cuts in each said direction is completely interrupted by the cuts of at least some of said rows in the opposite direction to provide said interlock.

16. The camouflage material of claim 11 wherein each of said rows of cuts in each said direction is interrupted by the cuts of alternate rows in the opposite direction to provide said interlock

17. The camouflage material of claim 11 wherein at least some of said cuts are generally W-shaped with two leg portions.

18. The camouflage material of claim 17 wherein the legs of at least some of the W-shaped cuts in the rows in one said direction extend into the rows in the opposite direction to provide said interlock.

19. The camouflage material of claim 17 wherein at least some of said cuts are generally truncated W-shaped cuts with one leg portion.

20. The camouflage material of claim 19 wherein the truncated portions of at least some of said truncated W-shaped cuts in the rows in one said direction extend into the rows in the opposite direction to provide said interlock.

21. A camouflage material comprising a sheet of material having a plurality of spaced apart rows of cuts extending across the sheet, at least some of the cuts being generally W-shaped with two leg portions and a pointed base portion, said sheet when pulled in a direction generally parallel to the leg portions of the cuts will cause the base portions of the cuts to extend beyond the plane of the sheet with the pointed configuration of the base portions of the cuts preventing the base portions from rolling.

22. The camouflage material of claim 21 wherein said rows of cuts are arranged in a pattern of interlocked, criss-crossed rows formed over the length and width of the sheet.

23. The camouflage material of claim 22 wherein at least some of the cuts in said rows thereof have portions extending into portions of adjacent cuts.

24. The camouflage material of claim 23 wherein said rows of cuts are spaced apart generally equidistant and generally parallel to each other in each said direction.

25. The camouflage material of claim 24 wherein at least some of said rows of cuts in one direction are completely interrupted by the cuts of at least some of the rows in the opposite direction to provide said interlock.

* * * * *